US005341570A

United States Patent [19]

Kumakawa

[11] Patent Number: 5,341,570

[45] Date of Patent: Aug. 30, 1994

[54] SPRING DRIVEN SHAVER

[75] Inventor: Tatsuaki Kumakawa, Ichikawa, Japan

[73] Assignee: Takara Co., Ltd., Tokyo, Japan

[21] Appl. No.: 14,277

[22] Filed: Feb. 5, 1993

[30] Foreign Application Priority Data

Oct. 16, 1992 [JP] Japan ..... 4-078176[U]

[51] Int. Cl.[5] ..... B26B 19/14

[52] U.S. Cl. ..... 30/43.6; 30/43.4

[58] Field of Search ..... 30/43.6, 43.5, 43.4; 475/183, 185

[56] References Cited

U.S. PATENT DOCUMENTS

| | | | |
|---|---|---|---|
| 703,845 | 7/1902 | Standish | 30/43.6 |
| 1,351,507 | 8/1920 | Collins | 30/43.6 |
| 1,598,329 | 8/1926 | Ursino | 30/43.6 |
| 2,808,645 | 10/1957 | Tournier | 30/43.6 |
| 2,851,772 | 9/1958 | Monnet | 30/43.6 |

*Primary Examiner*—Richard K. Seidel
*Assistant Examiner*—Hwei-Siu Payer
*Attorney, Agent, or Firm*—Price, Gess & Ubell

[57] ABSTRACT

A spring driven shaver capable of being significantly simplified in structure to a degree sufficient to carry out down-sizing of the shaver and be portable. The shaver includes a shaver body, in which a spiral spring, a spring wind-up wheel, a gear wheel coaxial with the spring wind-up wheel and a plurality of speed-up gears engaged with each other in order are arranged. One of the speed-up gears is engaged with the gear wheel and a gear shaft on which another one of the speed-up gears is mounted is arranged so as to upward extend from the shaver body and provided at an upper end thereof with a rotary member having blades mounted thereon. The spring wind-up wheel is so arranged that a part thereof is constantly projected from a side of the shaver body.

14 Claims, 2 Drawing Sheets

SPRING DRIVEN SHAVER

BACKGROUND OF THE INVENTION

This invention relates to a shaver having a spiral spring incorporated therein as a power or drive source, and more particularly to a spring driven shaver which is adapted to be conveniently used at any desired place.

A shaver which includes blades rotated for shaving conventionally uses a motor as a drive source. For this purpose, the conventional shaver is constructed so as to utilize a battery or a commercial power supply for driving the motor. Unfortunately, such construction of the conventional shaver causes a structure of the shaver to be substantially complicated to a degree sufficient to render down-sizing of the shaver highly difficult. Also, it fails to provide the shaver -with portability and causes an increase in manufacturing cost.

SUMMARY OF THE INVENTION

The present invention has been made in view of the foregoing disadvantage of the prior art.

Accordingly, it is an object of the present invention to provide a spring driven shaver which is capable of being significantly simplified in structure, to thereby accomplish the down-sizing.

It is another object of the present invention to provide a spring driven shaver which is capable of being readily portable.

It is a further object of the present invention to provide a spring driven shaver which is capable of accomplishing a decrease in manufacturing cost.

It is still another object of the present invention to provide a spring driven shaver which is capable of being serviceable at any desired place.

In accordance with the present invention, a spring driven shaver is provided. The spring driven shaver includes a shaver body, a spiral spring arranged in the shaver body, a spring wind-up wheel arranged in the shaver body for carrying out winding-up of the spiral spring, a gear wheel arranged in the shaver body in a manner to be coaxial with the spring wind-up wheel and associated with said spring wind-up wheel, and a speed-up gear train engaged with the gear wheel and including a plurality of speed-up gears mounted on gear shafts and engaged with each other in order. One of the gear shafts on which one of the speed-up gears is fitted is arranged so as to upwardly extend from the shaver body and be detachably mounted thereon with blades. The spring wind-up wheel is so arranged that a part thereof is projected from a side of the shaver body.

In the spring driven shaver of the present invention constructed as described above, the spiral spring is wound up by pressing the portion of the spring wind-up wheel projected from the side of the shaver body against a disk, a floor or the like to rotate it. An unwinding force of the spiral spring thus wound up is transmitted to the gear wheel arranged coaxial with the spring wind-up wheel and then through the speed-up gear train to the blades to rotate them for shaving. Thus, it will be noted that the spring driven shaver of the present invention is down-sized, readily portable, reduced in manufacturing cost and serviceable at any desired place.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like parts throughout; wherein.

DETAILED DESCRIPTION OF THE PREFERRED EMBODIMENT

Now, a spring driven shaver according to the present invention will be described hereinafter with reference to the accompanying drawings.

Figure 1:
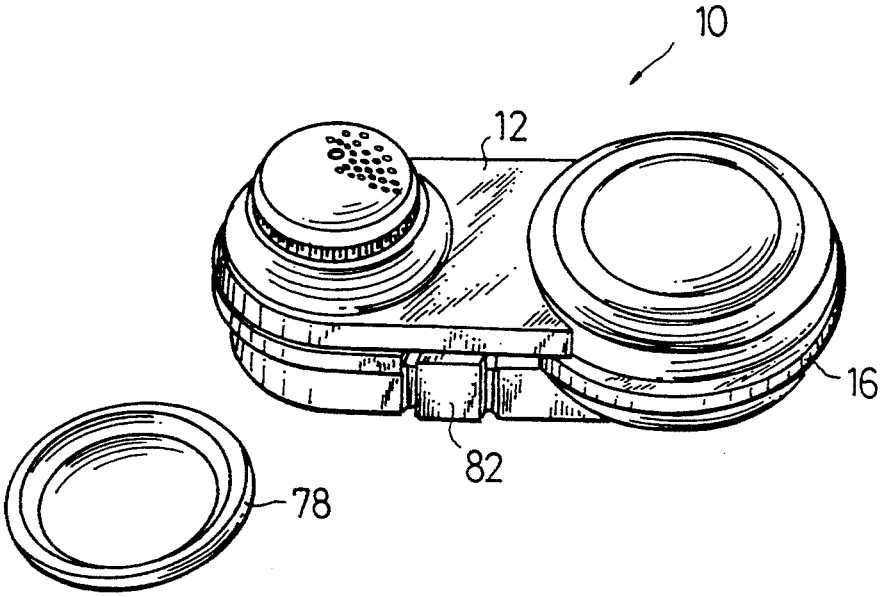
FIG. 1 is a perspective view generally showing an embodiment of a spring driven shaver according to the present invention.
Figure 2:
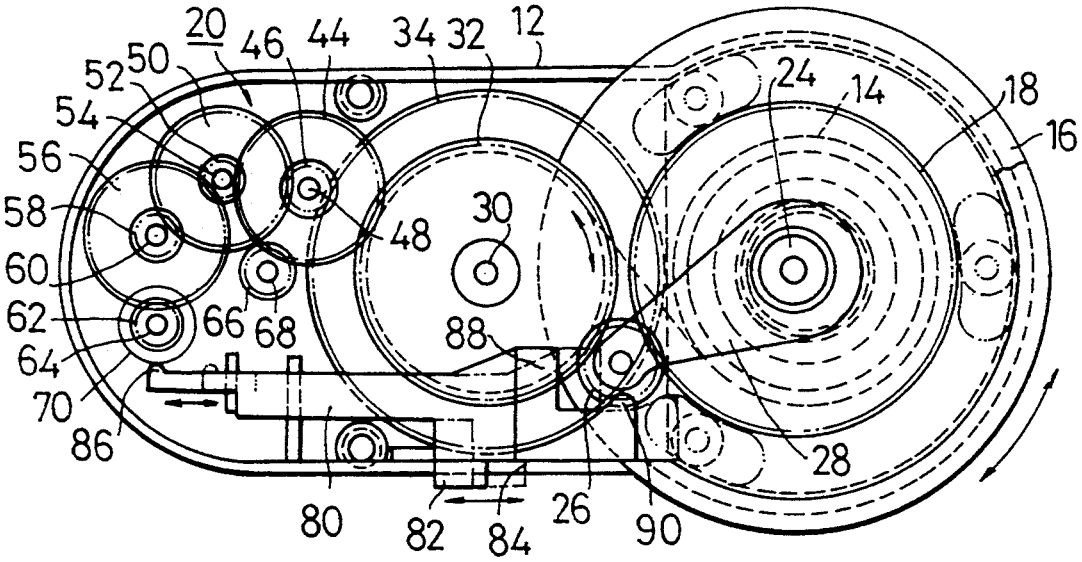
FIG. 2 is a schematic plan view showing an internal structure of the spring driven shaver of FIG. 1.
Figure 3:
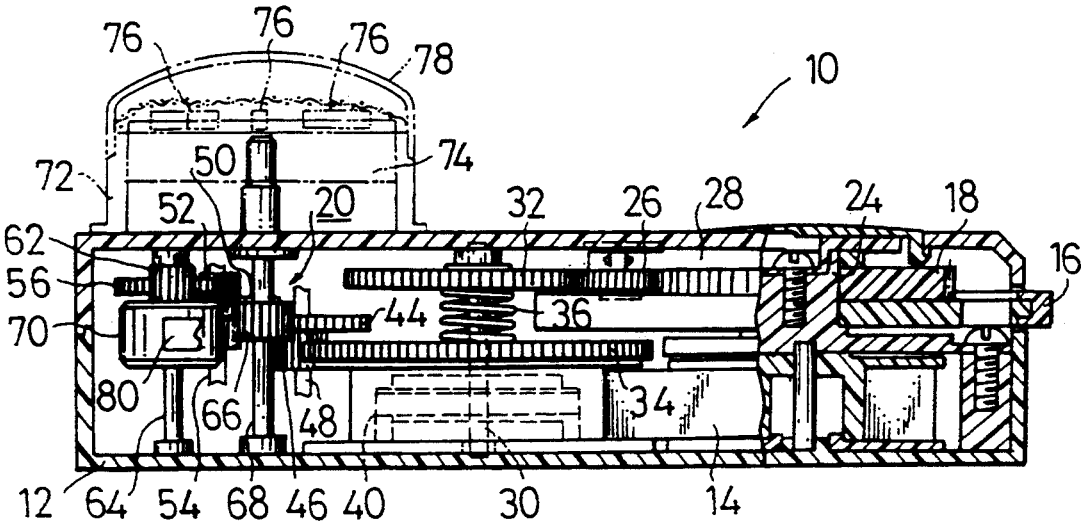
FIG. 3 is a vertical sectional view showing an internal structure of the spring driven shaver of FIG. 1.
Figure 4:
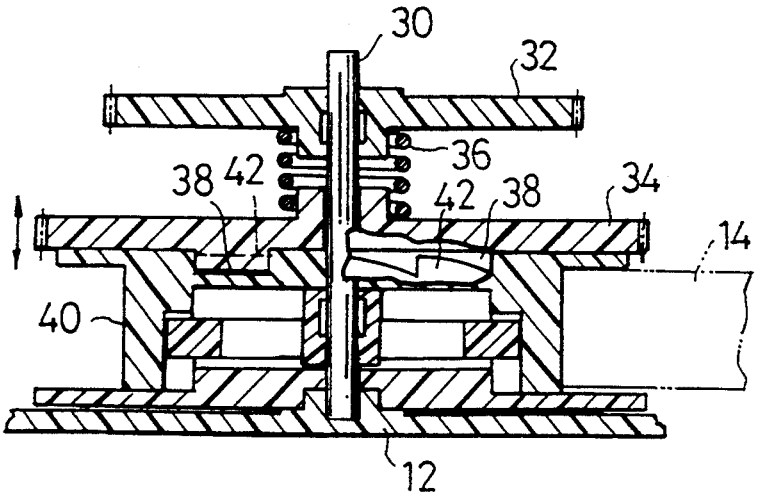
FIG. 4 is an enlarged vertical sectional view showing a relationship between a pawl section provided on a lower surface of an intermediate gear and a pawl section provided on an upper surface of a drum.

FIGS. 1 to 3 illustrate an embodiment of a spring driven shaver according to the present invention, wherein a spring driven shaver is generally designated at reference numeral 10. The spring driven shaver 10 of the illustrated embodiment, as shown in FIGS. 2 and 3, generally includes a shaver body 12, and a spiral spring 14 acting as a drive or power source, a spring wind-up wheel 16, a gear wheel 18 and a speed-up gear train 20 which are arranged in the shaver body 12. The spiral spring 14 is formed of an elongated strip-like material. The gear wheel 18 is arranged so as to be above and coaxial with the spring wind-up wheel 16. The speed-up gear train 20 includes a plurality of speed-up gears which are operatively engaged with the gear wheel 18 in order in a manner as described more detailedly hereinafter.

The spring wind-up wheel 16 is rotatably mounted on a first support shaft 24 which is arranged in the shaver body 12 so as to vertically extend. More particularly, the first support shaft 24 is positioned at a central portion thereof adjacent to one of ends of the shaver body 12 which are defined in a longitudinal direction of the shaver body 12 and the spring wind-up wheel 16 is loosely fitted on the first support shaft 24 so as to be rotatable about it. The spring wind-up wheel 16 is positioned below the gear wheel 18 and arranged in such a manner that a part of an outer peripheral portion thereof is projected from a side of the shaver body 12 or the above-described one end of the shaver body 12. The gear wheel 18 is likewise loosely fitted on the first support shaft 24 in a manner to be rotatable about the first support shaft 24 and fixed to the spring wind-up wheel 16. Reference numeral 26 designates a planetary gear which is engaged with the gear wheel 18 and reference numeral 28 is a link member pivotally mounted at a proximal end thereof on the support shaft 24. The planetary gear 26 is supported on a distal end of the link member 28. The spiral spring 14 is selectively wound on a portion of the support shaft 24 below the spring wind-up wheel 16 and fixed at one end thereof on the support shaft 24.

The shaver body 12 is also provided therein with a second support shaft 30, which is positioned at a central portion of the shaver body 12 and arranged so as to vertically extend. The second support shaft 30 is mounted thereon with a first intermediate gear 32 and a second intermediate gear 34. More particularly, the first intermediate gear 32 is fixedly fitted on the support shaft 30 and the second intermediate gear 34 is loosely fitted on the shaft 30 so as to be vertically movable along the second support shaft 30. Also, the second support shaft 30 is mounted on a portion thereof interposed between the first intermediate gear 32 and the second intermediate gear 34 with a coiled spring 36, so that the first and second intermediate gears 32 and 34 are kept spaced from each other at a predetermined interval through the coiled spring 36. The first intermediate gear 32 is detachably or releasably engaged with the planetary gear 26.

The second intermediate gear 34 is provided on a lower surface thereof with a plurality of first pawls 38, which are annularly intermittently arranged so as to be spaced from each other at predetermined intervals. The second support shaft 30 is also mounted thereon with a drum 40, which is fixedly fitted on the shaft 30 and positioned below the second intermediate gear 34. The drum 40 is provided on an upper surface thereof with a plurality of second pawls 42, which are annularly intermittently arranged so as to be spaced from each other at predetermined intervals, to thereby positionally correspond to the first pawls 38 of the second intermediate gear 34. Thus, the first pawls 38 and second pawls 42 are releasably engaged with each other. The spiral spring 36 is fixed at the other end thereof to the drum 40.

The speed-up gear train 20 is positioned in a central portion of the shaver body 12 adjacent to the other of the ends of the shaver body 12 which are defined in the longitudinal direction of the shaver body 12. The speed-up gear train 20, as shown in FIG. 2, includes a first speed-up gear 44 and a second speed-up gear 46 each mounted on a first gear shaft 48, a third speed-up gear 50 and a fourth speed-up gear 52 each mounted on a second gear shaft 54, a fifth speed-up gear 56 and a sixth speed-up gear 58 mounted on a third gear shaft 60, a seventh speed-up gear 62 mounted on a fourth gear shaft 64, and an eighth speed-up gear 66 mounted on a fifth gear shaft 68. The first speed-up gear 44 is engaged with the fourth speed-up gear 52 and eighth speed-up gear 66, whereas the second speed-up gear 46 is engaged with the second intermediate gear 34. The third speed-up gear 50 is engaged with the sixth speed-up gear 58. Then, the fifth speed-up gear 56 is engaged with the seventh speed-up gear 62. The fourth gear shaft 64 is fixedly mounted thereon with a flywheel 70, which functions to continue rotation of the speed-up gears.

The fifth gear shaft 68 on which the eighth speed-up gear 66 is so arranged that an upper end thereof, as shown in FIG. 3, is projected or extends into a blade housing 72 arranged on the central portion of the shaver body 12 adjacent to the other of the ends of the shaver body which are defined in the longitudinal direction of the shaver body 12 and formed into a flat cylindrical shape so as to permit a rotary member 74 having blades 76 mounted thereon to be housed therein. The rotary member 74 is detachably mounted on the fifth gear shaft 68. The blade housing is detachably mounted thereon with a cover member 78.

The shaver body 12, as shown in FIG. 2, is provided on one of both sides thereof defined along the longitudinal direction thereof with a control member 80 in a manner to be reciprocatable in the longitudinal direction. The control member 80 is provided on a substantially central portion thereof with a lug 82, which is formed integral with the control member 80 and arranged so as to be outwardly projected through an opening 84 formed on the one side of the shaver body 12. The control member 80 is provided on one end side thereof with a first engagement portion 86, which is arranged in a manner to be accessible to the the flywheel 70. Thus, the first engagement portion 86 is engaged with the flywheel 70 as indicated at solid lines when the control member 80 is moved in a left direction in FIG. 2, whereas the former is disengaged from the latter as indicated at phantom lines when the member 80 is moved in a right direction in FIG. 2. Also, the control member 80 is provided on the other end side thereof with a second engagement portion 88, which is adapted to be engaged with the distal end of the link member 28 to pivotally move the link member 28 in a counterclockwise direction in FIG. 2 about the first support shaft 24, to thereby release the engagement between the planetary gear 26 and the first intermediate gear 32 when the control member 80 is moved in the right direction in FIG. 2. Further, the control member 80 is provided on the other end side thereof with a stopper 90 for functioning to keep the planetary gear 26 separated from the first intermediate gear 32 at a predetermined interval when the second engagement portion 88 of the control member 80 releases engagement between the gears 26 and 32. The first engagement portion 86 is kept pressed against the flywheel 70 when engagement therebetween is accomplished.

Now, the manner of operation of the spring driven shaver of the illustrated embodiment constructed as described above will be described hereinafter.

First, the portion of the spring wind-up wheel 16 projected from the shaver body 12 is pressed against a desk, a floor or the like to rotate the wheel 16 while the first engagement portion 86 of the control member 80 is kept pressedly abutted against the flywheel 70, so that the gear wheel 18 fitted on the first support shaft 24 and fixed onto the spring wind-up wheel 16 may be rotated. Such rotation of the gear wheel 18 permits the planetary gear 26 to be moved because the gear wheel 18 is engaged with the planetary gear 26, so that the planetary gear 26 is caused to be engaged with the first intermediate gear 32 mounted on the second support shaft 30, leading to rotation of the first intermediate gear 32.

The rotation of the first intermediate gear 32 causes the drum 40 mounted on the second support shaft 30 to be rotated, resulting in the spiral spring 14 wound on the first support shaft 24 at the position below the gear wheel 18 being wound up on the drum 40. During the winding-up of the spiral spring 14 on the drum 40, the spiral spring 14 wound up on the drum 40 is apt to unwind. However, such unwinding of the spiral spring 14 is effectively prevented due to engagement between the second pawls 42 annularly intermittently arranged on the upper surface of the drum 40 and the first pawls 38 annularly intermittently arranged on the lower surface of the second intermediate gear 34 which is not permitted to rotate, through the gear train 20, by a brake acting on the flywheel 70 from the control member 80. The winding-up of the spring 14 on the drum 40 is smoothly carried out irrespective of arrangement of the mutually engageable pawls 38 and 42, because rotation of the drum 40 causes the second intermediate gear 34 to be upward moved along the second support shaft 30 against the coiled spring 36, to thereby release engagement between the pawls 38 and 42.

Then, the lug 82 of the control member 80 is pressed to move the control member to release engagement between the first engagement portion 86 of the control member 80 and the flywheel 70 while the spiral spring 14 is kept wound up on the drum 40. This results in the spiral spring 14 unwinding to rotate the first and second intermediate gears 32 and 34, leading to rotation of the speed-up gear train 20. The fifth gear shaft 68 on which the eighth speed-up gear 66 which is one of the gears constituting the gear train 20 is mounted is detachably mounted thereon with the rotary member 74 having the blades 76 mounted thereon, so that the rotary member 74 may be likewise rotated to lead to rotation of the blades 76 for shaving.

As can be seen from the foregoing, the spring driven shaver of the present invention is significantly simplified in structure to a degree sufficient to accomplish down-sizing of the shaver and render it portable. Also, the spring driven shaver of the present invention permits the manufacturing cost to be substantially decreased. Further, the spring driven shaver of the present invention is effectively serviceable at any desired place because of incorporating therein the spiral spring as a drive source.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise as than as specifically described.

What is claimed is:

1. A spring driven shaver comprising:

a shaver body;

a spiral spring arranged in said shaver body;

a spring wind-up wheel arranged in said shaver body for carrying out a winding-up movement of said spiral spring to store spring energy;

a gear member arranged in said shaver body in a manner to be coaxial with said spring wind-up wheel and movable with said spring wind-up wheel;

a speed-up gear train engageable with said gear member and including a plurality of speed-up gears mounted on gear shafts and engaged with each other in order;

a blade assembly mounted in said shaver body, one of said gear shafts on which one of said speed-up gears is fitted being arranged so as to upwardly extend from said shaver body and be detachably mounted thereon with said blade assembly, said spring wind-up wheel being mounted so that a part thereof is projected from a side of said shaver body to enable a contact movement of said wind-up wheel to rotate it in engagement with said gear member; and control means for controlling the movement of said speed-up gear train by the spring energy stored in said spiral spring including a planetary gear for selectively engaging said gear member with said speed-up gear train to release the stored spring energy and to alternatively release engagement of said planetary gear between said gear member and said speed-up gear train.

2. A spring driven shaver as defined in claim 1, wherein said planetary gear is operatively connected indirectly to said speed-up gear train.

3. A spring driven shaver as defined in claim 2, further including first and second intermediate gears, wherein said planetary gear is operatively connected to said speed-up gear train through said first and second intermediate gears.

4. A spring driven shaver as defined in claim 3, further comprising a drum on which said spiral spring is wound up due to rotation of said spring wind-up wheel;

said drum being arranged coaxial with said first and second intermediate gears.

5. A spring driven shaver as defined in claim 4, further comprising a clutch means arranged between said first intermediate gear and said second intermediate gear.

6. A spring driven shaver as defined in claim 5, wherein said first and second intermediate gears are arranged so as to be moved relative to each other;

said clutch means including a coiled spring interposed between said first intermediate gear and said second intermediate gear to generate an elastic force acting to separate said first and second intermediate gears from each other, and first and second pawl means are arranged so as to be selectively engaged with each other.

7. A spring driven shaver as defined in claim 6, wherein said first pawl means is provided on one of said first and second intermediate gears and said second pawl means is provided on said drum.

8. A spring driven shaver comprising:

a shaver body;

a spiral spring arranged in said shaver body;

a spring wind-up wheel rotatably arranged in said shaver body and operatively connected to said spiral spring to carry out winding-up of said spiral spring;

a gear wheel arranged in said shaver body in a manner to be coaxial with said spring wind-up wheel and rotatable integrally with said spring wind-up wheel;

a speed-up gear grain engageable with said gear wheel and including a plurality of speed-up gears mounted on gear shafts and engaged with each other in order, one of said gear shafts on which one of said speed-up gears is fitted being arranged so as to be upwardly extended from said shaver body and detachably mounted thereon with blades, said spring wind-up wheel being so arranged that a part of an outer peripheral portion thereof is projected radially outward from a side of said shaver body, said spiral spring being wound-up by rotating said spring wind-up wheel while said outer peripheral portion of said wind-up wheel is pressed against a support surface; and an actuation control means for providing an engagement with said gear wheel for controlling actuation of said speed-up gear train.

9. A spring driven shaver as defined in claim 8 wherein said actuation control means comprises a planetary gear member rotatably mounted on said gear wheel and a link member pivotably mounted to the planetary gear member for controlling actuation with said speed-up gear train.

10. A spring driven shaver as defined in claim 9, further including a flywheel, wherein said actuation control means is operatively connected to said speed-up gear train through said flywheel.

11. A spring driven shaver as defined in claim 8 wherein said actuation control means is operatively connected indirectly to said speed-up gear train.

12. A spring driven shaver comprising:

a shaver body of a configuration to be held in an operator's hand, the shaver body has an opening;

a spring member arranged in the shaver body to be wound up to store spring energy;

a gear transmission assembly operatively connected to the spring member to store spring energy;

a rotatable blade assembly for cutting hair is mounted in the shaver body and connected to the gear transmission assembly to rotate the blade assembly with the stored spring energy.

a spring wind-up wheel is rotatably mounted in the shaver body and extends externally of the shaver body through the opening, the spring wind-up wheel is operatively connected to the gear transmission assembly and rotation of an external surface of the spring wind-up wheel extending outwardly of the shaver body through the opening will store spring energy; and a control member mounted in the shaver body and movable to respectively engage the spring wind-up wheel with the gear transmission assembly and to permit it to disengage.

13. A spring driven shaver comprising:

a shaver body;

a spiral spring arranged in said shaver body;

a spring wind-up wheel rotatably arranged in said shaver body and operatively connected to said spiral spring to carry out winding-up of said spiral spring;

a gear wheel arranged in said shaver body in a manner to be coaxial with said spring wind-up wheel and rotatable integrally with said spring wind-up wheel;

a speed-up gear train engageable with said gear wheel and including a plurality of speed-up gears mounted on gear shafts and engaged with each other in order, one of said gear shafts on which one of said speed-up gears is fitted being arranged so as to be upwardly extended from said shaver body and detachably mounted thereon with blades, said spring wind-up wheel being so arranged that a part of an outer peripheral portion thereof is projected radially outward from a side of said shaver body, said spiral spring being wound-up by rotating said spring wind-up wheel while said outer peripheral portion of said wind-up wheel is pressed against a support surface;

a rotatable drum; and a first shaft rotatably supporting the spring wind-up wheel and the gear wheel, one end of the spiral spring being fixed to said first shaft and the other end of said spiral spring being fixed to said rotatable drum so that said spiral spring may be wound onto said first shaft and said rotatable drum.

14. A spring driven shaver comprising:

a shaver body;

a spiral spring arranged in said shaver body;

a spring wind-up wheel rotatably arranged in said shaver body and operatively connected to said spiral spring to carry out winding-up of said spiral spring;

a gear wheel arranged in said shaver body in a manner to be coaxial with said spring wind-up wheel and rotatable integrally with said spring wind-up wheel;

a speed-up gear train engageable with said gear wheel and including a plurality of speed-up gears mounted on gear shafts and engaged with each other in order, one of said gear shafts on which one of said speed-up gears is fitted being arranged so as to be upwardly extended from said shaver body and detachably mounted thereon with blades, said spring wind-up wheel being so arranged that a part of an outer peripheral portion thereof is projected radially outward from a side of said shaver body, said spiral spring being wound-up by rotating said spring wind-up wheel while said outer peripheral portion of said wind-up wheel is pressed against a support surface;

a flywheel operatively connected to said speed-up gear train; and an actuation control means for controlling the movement of said speed-up gear train including an engagement portion that can be engaged with and disengaged from said flywheel to thereby act as a braking force on the speed-up gear train when the engagement portion of the actuation control means is engaged with said flywheel.

* * * * *